US006594463B2

(12) United States Patent
Watanabe

(10) Patent No.: US 6,594,463 B2
(45) Date of Patent: Jul. 15, 2003

(54) IMAGE FORMING APPARATUS AND METHOD WITH INTERMEDIATE TRANSFER MEMBER

(75) Inventor: Takeshi Watanabe, Ichikawa (JP)

(73) Assignees: Kabushiki Kaisha Toshiba, Tokyo (JP); Toshiba Tec Kabusgiki Kaisha, Tokyo (JP)

( * ) Notice: Subject to any disclaimer, the term of this patent is extended or adjusted under 35 U.S.C. 154(b) by 0 days.

(21) Appl. No.: 09/934,599

(22) Filed: Aug. 23, 2001

(65) Prior Publication Data

US 2003/0044203 A1 Mar. 6, 2003

(51) Int. Cl.[7] ..... G03G 15/01
(52) U.S. Cl. ..... 399/302
(58) Field of Search ..... 399/302, 303, 399/308

(56) References Cited

U.S. PATENT DOCUMENTS

| | | | | | |
|---|---|---|---|---|---|
| 4,455,079 | A | * | 6/1984 | Miwa et al. | 399/302 |
| 4,607,940 | A | * | 8/1986 | Quang | 399/202 X |
| 5,469,247 | A | | 11/1995 | Cheng et al. | 355/296 |
| 6,078,776 | A | * | 6/2000 | Okamoto et al. | 399/308 |
| 6,226,465 | B1 | * | 5/2001 | Funatani | 399/302 X |

FOREIGN PATENT DOCUMENTS

| | | | |
|---|---|---|---|
| JP | 4-50986 | * | 2/1992 |
| JP | 4-355465 | * | 12/1992 |
| JP | 8-30120 | | 2/1996 |
| JP | 11-212379 | | 8/1999 |

OTHER PUBLICATIONS

U.S application Ser. No. 09/662,829, Watanabe, filed Sep. 15, 2000.

U.S. application Ser. 09/667,551, Watanabe, filed Sep.15, 2000.

* cited by examiner

*Primary Examiner*—Fred L. Braun
(74) *Attorney, Agent, or Firm*—Foley & Lardner

(57) ABSTRACT

An image forming apparatus and image forming method in which the apparatus includes an image carrier, an electrostatic latent image forming mechanism which forms an electrostatic latent image on the image carrier; and a developing mechanism which develops the electrostatic latent image on the image carrier to attain a visible image. A first transfer mechanism presses an intermediate transfer member into contact with the image carrier to transfer the visible image on the image carrier to the intermediate transfer member. An application mechanism applies a viscous material onto the intermediate transfer member and a second transfer mechanism transfers a transferred image, transferred to the intermediate transfer member, to a transfer member to which transfer is to be done. The viscosity of the viscous material on the first transfer mechanism is different from the viscosity of the viscous material on the second transfer mechanism An adhesive agent may be applied to the intermediate transfer member prior to and subsequent to transfer of the visible image to the intermediate transfer member.

29 Claims, 7 Drawing Sheets

IMAGE FORMING APPARATUS AND METHOD WITH INTERMEDIATE TRANSFER MEMBER

BACKGROUND OF THE INVENTION

The present invention relates to an image forming apparatus and particularly to an image forming apparatus using a liquid developing agent.

An image forming apparatus such as an electrophotographic apparatus, an electrostatic recording apparatus, or the like, using a liquid developing agent, has an advantage which cannot be realized by an image forming apparatus using a dry developing agent. Its value has been reconsidered in recent years. That is, main advantages of a wet image forming apparatus are that high image quality can be realized since very fine toner of a sub-micron size can be used, that it is economic since a sufficient image density can be obtained by a small amount of toner, and that an image quality equivalent to printing can be obtained.

Meanwhile, a wet image forming apparatus using conventional liquid toner has several problems. Therefore, the dry technique has been an occupant so long. As one of these problems, a problem in transfer will be mentioned. The first problem in transfer is deterioration of image quality. That is, conventionally, a toner image on a photoconductive member is directly transferred to a paper by a transfer means using an electric field, so that uneven transfer is caused due to fluctuation of the electric field corresponding to convexes and concaves on the paper surface. In addition, transfer errors are easily caused due to fluctuation of electric characteristics and environmental dependency of papers, so that the image quality of transferred images is greatly deteriorated.

To solve these problems, a proposal has been made for an apparatus which once transfers a toner image from a photoconductive member to an intermediate transfer member and thereafter transfers it to a paper. U.S. Pat. Nos. 5,148,222, 5,166,734, and 5,208,637 disclose an apparatus which transfers a toner image from a photoconductive member to an intermediate member by an electric field and thereafter transfers it to a paper by pressure (and heat).

According to these apparatuses, it is relatively easy to form the intermediate transfer member from a material which has a flat surface and less variants and changes in electric resistance. Therefore, compared with the case of directly transferring a toner image on a photoconductive member to a paper, deterioration of image quality due to transfer is improved although a transfer efficiency of 100% cannot be achieved. In addition, since the electric field transfer uses electrophoresis, a large amount of solvent must remain in the toner image at the time of transfer. This solvent moves to the intermediate member and is vaporized by heat, thereby causing a problem that a large amount of vapor of the solvent is generated.

Meanwhile, Japanese Patent Application KOKOKU Publication No. 46-41679, Japanese Patent Application KOKAI Publication No. 62-280882, and the like disclose an apparatus which does not use the electric field transfer but utilizes pressure (and heat) in both of transfer from a photoconductive member to an intermediate transfer member and transfer from the intermediate transfer member to a paper. According to these apparatuses, image quality is less deteriorated. Further, in many cases, the solvent in the toner image is substantially vaporized before the primary transfer from the photoconductive member to the intermediate transfer member, thereby to reduce the solvent in the toner image as much as possible. As a result, generated vapor of solvent is reduced.

However, if pressure (and heat) is thus used in both of the transfer from the photoconductive to the intermediate member and the transfer from the intermediate member to a paper, it is difficult to optimize releasing characteristic (surface energy) of the surfaces of the intermediate member and the photoconductive member, so that excellent transfer is difficult to carry out stably.

As a countermeasure thereof, the intermediate member is formed of an elastic member having relatively low surface energy, and the surface of the intermediate transfer member is provided with an appropriate tack characteristic. In the step of the primary transfer of the toner image from the photoconductive member to the intermediate transfer member, the transfer is carried out using mainly the tack characteristic (slight adhesion) between the intermediate transfer member and toner, and in the step of secondary transfer of the toner image from the intermediate member to a paper, a method in which fixing is simultaneously performed at the same time as the transfer by pressure and heat, using the releasing characteristic has been considered. This method is proposed by the present inventors (Japanese Patent Applications No. 11-235488 and 11-269265).

However, in this method, it is difficult to maintain the tack force of the intermediate member for a long period. In addition, the releasing characteristic of the intermediate member influences the secondary transfer. Particularly, in case where the intermediate transfer member is made of silicone-based material, the silicone oil component having a low molecular weight oozes out to its surface, thereby to improve the releasing characteristic. However, if the intermediate member is exposed to solvent of liquid toner for a long period, the releasing characteristic is spoiled. As a result of this, transfer performance is degraded in both of the primary transfer step and the secondary transfer step.

If material having a tackiness is used for the intermediate member, a paper is strongly adhered to the intermediate member, at the time of fixing simultaneously performed together with transfer. Consequently, the paper is difficult to pass through, with a peeling means such as a peeling claw or the like which is generally used.

BRIEF SUMMARY OF THE INVENTION

An object of the present invention is to provide an image forming apparatus which comprises an intermediate transfer member, has excellent transfer characteristics, and is thereby capable of forming an image with high image quality.

Another object of the present invention is to provide an image forming method which uses an intermediate transfer member, has excellent transfer characteristics, and is thereby capable of forming an image with high image quality.

According to the present invention, there is provided an image forming apparatus comprising: an image carrier; an electrostatic latent image forming mechanism which forms an electrostatic latent image on the image carrier; a developing mechanism which develops the electrostatic latent image on the image carrier to attain a visible image; a first transfer mechanism which presses an intermediate transfer member into contact with the image carrier, to transfer the visible image on the image carrier to the intermediate transfer member; an application mechanism which applies a viscous material onto the intermediate transfer member; and a second transfer mechanism which transfers a transferred image transferred to the intermediate transfer member to a transfer member to which transfer is to be done.

Also, according to the present invention, there is provided an image forming apparatus comprising: an image carrier; an electrostatic latent image forming mechanism which forms an electrostatic latent image on the image carrier; a developing mechanism which develops the electrostatic latent image on the image carrier to attain a visible image; a first transfer mechanism which presses an intermediate transfer member into contact with the image carrier, to transfer the visible image on the image carrier to the intermediate transfer member; an application mechanism which applies a releasing agent onto the intermediate transfer member, in an upstream side of the first transfer mechanism; and a second transfer mechanism which transfers a transferred image transferred to the intermediate transfer member to a transfer member to which transfer is to be done, by applying pressure and heat thereto.

Further, according to the present invention, there is provided an image forming apparatus comprising: an image carrier; an electrostatic latent image forming mechanism which forms an electrostatic latent image on the image carrier; a developing mechanism which develops the electrostatic latent image on the image carrier to attain a visible image; a first transfer mechanism which presses an intermediate transfer member into contact with the image carrier, to transfer the visible image on the image carrier to the intermediate transfer member; a second transfer mechanism which transfers a transferred image transferred to the intermediate transfer member to a transfer member to which transfer is to be done; a first application mechanism which applies a first adhesive agent onto the intermediate transfer member, after the transferred image on the intermediate transfer member is transferred to the transfer member to which transfer is to be done, at the second transfer mechanism, before the visible image on the image carrier is transferred to the intermediate transfer member, at the first transfer mechanism; and a second application mechanism which applies a second adhesive agent onto the intermediate transfer member, after the visible image on the image carrier is transferred to the intermediate transfer member, at the first transfer mechanism, before the transferred image on the intermediate transfer member is transferred to the transfer member to which transfer is to be done, at the first transfer mechanism.

Also further, according to the present invention, there is provided an image forming apparatus comprising: an image carrier; an electrostatic latent image which forms an electrostatic latent image on the image carrier; a developing mechanism which develops the electrostatic latent image on the image carrier to attain a visible image; a first transfer mechanism which presses a belt-like intermediate transfer member into contact with the image carrier, to transfer the visible image on the image carrier to the intermediate transfer member; a second transfer mechanism which presses the belt-like intermediate transfer member into contact with a transfer member to which transfer is to be done, by a transfer roller and a pressure application member opposed thereto, thereby to transfer a transferred image on the belt-like intermediate transfer member to the transfer member to which transfer is to be done; and a separation mechanism which is provided in a downstream side of the second transfer mechanism and has a curvature larger than that of the transfer roller, to separate the transfer member to which transfer is to be done, from the belt-like intermediate transfer member.

Also, according to the present invention, there is provided an image forming apparatus comprising: an image carrier; an electrostatic latent image which forms an electrostatic latent image on the image carrier; a developing mechanism which develops the electrostatic latent image on the image carrier to attain a visible image; a first transfer mechanism which presses a belt-like intermediate transfer member into contact with the image carrier, to transfer the visible image on the image carrier to the intermediate transfer member; a pre-heat roller which is provided in a downstream side of the first transfer mechanism and heats the belt-like intermediate transfer member from a back surface of the belt-like intermediate transfer member; and a second transfer mechanism which presses the belt-like intermediate transfer member into contact with a transfer member to which transfer is to be done, by a pressure application member, thereby to transfer a transferred image on the belt-like intermediate transfer member to the transfer member to which transfer is to be done, and has a curvature larger than a diameter of 30 mm, thereby to separate the transfer member to which transfer is to be done, from the belt-like intermediate transfer member.

Further, according to the present invention, there is provided an image forming apparatus comprising: an image carrier; an electrostatic latent image which forms an electrostatic latent image on the image carrier; a developing mechanism which develops the electrostatic latent image on the image carrier to attain a visible image; a first transfer mechanism which presses a belt-like intermediate transfer member into contact with the image carrier, to transfer the visible image on the image carrier to the intermediate transfer member; a pre-heat tight contact member which is provided in a downstream side of the first transfer mechanism, heats the belt-like intermediate transfer member from a back surface of the belt-like intermediate transfer member, and lets the belt-like intermediate transfer member be into tight contact with the transfer member to which the belt-like intermediate transfer member, by a pressure application member; and a second transfer mechanism which is provided in a downstream side of the first transfer mechanism, presses the belt-like intermediate transfer member into contact with a transfer member to which transfer is to be done, by a pressure application member, thereby to transfer a transferred image on the belt-like intermediate transfer member to the transfer member to which transfer is to be done, and has a curvature larger than a diameter of 30 mm, thereby to separate the transfer member to which transfer is to be done, from the belt-like intermediate transfer member, wherein a pressure applied to the belt-like intermediate transfer member and the transfer member to which transfer is to be done at the pre-heat tight contact mechanism at the second transfer mechanism is larger than a pressure applied to the belt-like intermediate transfer member and the transfer member to which transfer is to be done at the pre-heat tight contact mechanism.

Also further, according to the present invention, there is provided an image forming method comprising: a step of forming an electrostatic latent image on an image carrier; a step of developing the electrostatic latent image on the image carrier to attain a visible image; a first transfer step of pressing an intermediate transfer member into contact with the image carrier, to transfer the visible image on the image carrier to the intermediate transfer member; a step of applying an adhesive agent or releasing agent onto the intermediate transfer member; and a second transfer step of transferring a transferred image transferred to the intermediate transfer member to a transfer member to which transfer is to be done.

Further, according to the present invention, there is provided an image forming method comprising: a step of an electrostatic latent image which forms an electrostatic latent image on an image carrier; a step of developing the electrostatic latent image on the image carrier to attain a visible image; a first transfer step of pressing an intermediate transfer member into contact with the image carrier, to transfer the visible image on the image carrier to the intermediate transfer member; a second transfer step of transferring a transferred image transferred to the intermediate transfer member to a transfer member to which transfer is to be done; a first application step of applying a first adhesive agent onto the intermediate transfer member, after the transferred image on the intermediate transfer member is transferred to the transfer member to which transfer is to be done, at the second transfer step, before the visible image on the image carrier is transferred to the intermediate transfer member, at the first transfer mechanism; and a second application step of applying a second adhesive agent to the intermediate transfer member, after the visible image on the image carrier is transferred to the intermediate transfer member, at the first transfer step, before the transferred image on the intermediate transfer member is transferred to the transfer member to which transfer is to be done, at the first transfer step.

Also further, according to the present invention, there is provided an image forming method comprising: a step of an electrostatic latent image which forms an electrostatic latent image on an image carrier; a step of developing the electrostatic latent image on the image carrier to attain a visible image; a first transfer step of pressing a belt-like intermediate transfer member into contact with the image carrier, to transfer the visible image on the image carrier to the intermediate transfer member; a second transfer step of pressing the belt-like intermediate transfer member into contact with a transfer member to which transfer is to be done, by a transfer roller and a pressure application member opposed thereto, thereby to transfer a transferred image on the belt-like intermediate transfer member to the transfer member to which transfer is to be done; and a step of separating the transfer member to which transfer is to be done, from the belt-like intermediate transfer member, by a separation roller which is provided in a downstream side of the second transfer mechanism and has a curvature larger than that of the transfer roller.

DETAILED DESCRIPTION OF THE INVENTION

Figure 1:
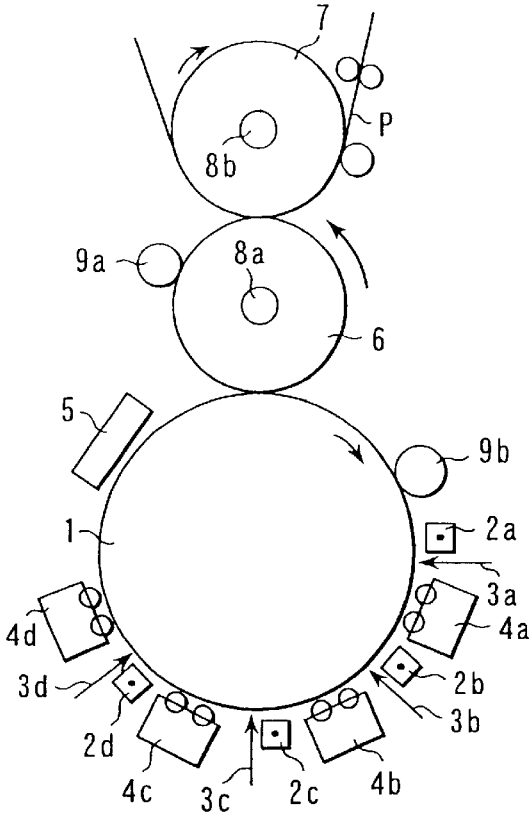
FIG. 1 is a view showing an example of the structure of a wet electrophotographic apparatus which is applied to various embodiments of the present invention.

The present invention solves the problem specific to a wet electrophotographic apparatus in which transfer is effected by applying pressure (and heat) without using an electric field, with an intermediate transfer member being inserted between a photoconductive member and an object to which transfer is effected. That is, the present invention aims to improve the transfer efficiency by using various means, such as application of viscous material (oily material) serves as an adhesive compound or a releasing agent to the surface of the intermediate transfer member, control of the viscosity of the viscous material, use of a separation roller a large curvature, and/or provision of a difference between circumferential speeds of the photoconductive member and the intermediate transfer member, in the primary transfer of a developer image from the photoconductive member to the intermediate transfer member and in the secondary transfer of the developer image from the intermediate transfer member to the object to which the image is transferred.

In an aspect of the present invention, deterioration of the primary transfer can be prevented without lowering the tackiness of the surface of the intermediate transfer member, by applying viscous material to the surface of the intermediate transfer member constantly or in a constant cycle. In this case, at the time of secondary transfer, the viscosity of the viscous material is lowered at a high temperature, thereby to function as a releasing agent from the intermediate transfer member, so deterioration of the secondary transfer is prevented.

As an example of the viscous material, silicone oil having a high viscosity can be used at the time of primary transfer.

The technique of applying silicone oil or the like to the intermediate transfer member was disclosed in several references in the field of the dry electrophotographic apparatus. In Japanese Patent Application KOKAI Publication No. 8-30120 and Japanese Patent Application KOKAI Publication No. 11-212379, abrasion resistance is improved by applying periodically or continuously silicone oil to an intermediate transfer member, thereby to extend the lifetime of the intermediate transfer member. In these cases, the silicone oil improves lubrication characteristic of the intermediate transfer member but does not provide tackiness the surface of the intermediate transfer member. In addition, these techniques are basically constructed such that dry toner is transferred by an electric field. The silicone oil does not contribute to transfer at all.

In addition, where viscous material is applied to the intermediate transfer member before primary transfer and it is further applied again after the primary transfer, a more advantageous effect can be attained. In this case, viscous material having a relatively low viscosity is applied before the primary transfer and viscous material having higher viscosity than that applied before the primary transfer is applied after the primary transfer before secondary transfer. In this manner, even if there is no temperature difference at the intermediate transfer member between the primary transfer and the secondary transfer, excellent secondary transfer can be achieved due to difference in the tackiness. In this case, the viscous material applied before the primary transfer functions as a releasing agent in the secondary transfer, and the other viscous material applied after the primary transfer before the secondary transfer functions as an adhesive agent in the secondary transfer.

Also, if viscous material having low viscosity is used, the primary transfer is difficult because the tackiness is low. However, the primary transfer is not hindered if the application amount is small. Meanwhile, since it has an excellent releasing characteristic, it is therefore effective in the meaning of stabilization of the secondary transfer. Hence, the secondary transfer characteristics can be stabled for a long period, by applying viscous material having relatively low viscosity as a releasing agent.

Of course, the viscous material used for application to the surface of the intermediate transfer member, which has been explained above, needs not always be silicone oil. Any material can be used as long as it has viscosity within a range as described above. Dimethyl silicone oil has a small change rate of viscosity in relation to temperature change and is thus stable thermally. Therefore, in order to make a viscous material function as both of an adhesive agent and a releasing agent, another kind of oil than silicone oil may rather be preferred more in some cases. For example, if an oil such as an ester oil, cylinder oil, polyether, spindle oil, or the like is used, and the viscosity is controlled by cooling or heating, handling is easy because the viscosity largely changes depending on temperature change.

In another aspect of the present invention, the intermediate transfer member is constructed like a belt, and a separation roller having a large curvature is arranged in the downstream side of a secondary transfer section. In this manner, papers are prevented from being adhered to the intermediate transfer member. If the transfer roller itself is configured to have a small diameter, the belt transfer member cannot be sufficiently heated before transfer and is therefore not suitable for high speed operation. In addition, it is impossible to ensure an enough transfer nip. Hence, a separation roller is provided in the downstream side of the transfer roller. The diameter of the separation roller is preferably about 30 mm or less.

Since it is difficult to heat a roller having a small diameter, an intermediate transfer member, a cleaner roller, or the like, which has a relatively large diameter and includes a heater, may be pressed into contact with the separation roller with a belt intermediate member inserted, immediately after separation of a paper, so that the intermediate transfer member is maintained at a high temperature at the time of separation.

Further, in case of applying viscous material before primary transfer in this kind of structure, excellent separation between the transfer member and a paper if the viscosity of the viscous material is in the order: on separation roller the time of secondary transfer>time of primary transfer. If the transfer roller itself is configured to have a small diameter of 30 mm or less, a pre-heating roller for pre-heating the intermediate belt may be arranged in the upstream side of the secondary transfer section. In this case, if the intermediate transfer belt and the paper are pressed into tight contact with each other by the pre-heating roller and an impression cylinder to pre-heat them together with a paper and if the paper is simultaneously separated by the transfer roller having a small diameter as it is transferred, the transfer characteristics can be more stabled. Further, if viscous material is applied to the belt transfer member such that the viscosity at the time of transfer/separation is lower than the viscosity at the time of primary transfer, excellent primary transfer and also excellent secondary transfer can be attained stably for a long period.

In the following, various embodiments of the present invention will be explained in details with reference to the drawings. At first, explanation will be made of an image forming apparatus to which various embodiments of the present invention are applied.

FIG. 1 is a view schematically showing the structure. In FIG. 1, an image carrier 1 is a photoconductive drum constructed by providing a photoconductive layer such as organic-based material, amorphous based material, or the like, on a conductive base member. Around this image carrier 1, there are provided a first charger 2*a*, a first laser exposure system 3*a*, a first developing device 4*a*, a second charger 2*b*, a second laser exposure system 3*b*, a second developing device 4*b*, a third charger 2*c*, a third laser exposure system 3*c*, a third developing agent 4*c*, a fourth charger 2*d*, a fourth laser exposure system 3*d*, and a fourth developing device 4*d* orderly in the clockwise direction.

As the first to fourth chargers 2*a* to 2*d*, well-known corona chargers or scorotron chargers can be used.

In the downstream side of the fourth developing device 4*d*, a pre-transfer dryer 5 is provided. In the downstream side thereof, a transfer roller 6 is provided. A pressure application roller 7 is provided in contact with an intermediate transfer roller 6, such that papers are supplied to between the intermediate transfer roller 6 and the pressure application roller 7. At the center parts of the intermediate transfer roller and the pressure application roller 7, heaters 8*a* and 8*b* are provided respectively. The apparatus shown in FIG. 1 is further provided with a first cleaner 9*a* in contact with the intermediate transfer roller 6 and a second cleaner 9*b* in contact the image carrier 1 before the first charger 2*a*.

According to the image forming apparatus constructed as described above, image formation is carried out as described below.

At first, the image carrier 1 is charged uniformly by the first charger 2*a* and is thereafter exposed with an image-modulated laser beam from the first laser exposure system, so that an electrostatic latent image is formed on its surface.

Thereafter, the electrostatic latent image is visualized by the first developing device 4*a* which contains a liquid developing agent.

It is possible to use, as a liquid developing agent, for example, a hydrocarbon-based insulative solvent such as ISOPER (phonetic translation) G, L, and M, NOLPER (phonetic translation) 12, 13, and 15, and the like manufactured by EXXSON, in which acryl-based resin or the like having a glass-transition temperature (Tg) ranging from −5° C. to 70° C. is dispersed, wherein metal soap for controlling electric charges and pigments corresponding to respective colors are applied to the solvent.

A liquid developing agent used in the present embodiment is prepared in the following manner, for example. Metal soap for controlling charges, pigments corresponding to respective colors, acrylic-ester-based copolymer, a dispersion agent, and the like are added to ISOPER L and are mixed and dispersed by a paint shaker in the existence of glass beads, to prepare a concentrated liquid developing agent. Subsequently, the obtained concentrated developing agent is diluted with ISOPER L such that the nonvolatile component concentration is 1 wt %, and further, 50 wt % of zirconium naphtenate (including a nonvolatile component of 49 wt %) manufactured by DAINIPPON INK AND CHEMICALS, INCORPORATED is added to the nonvolatile component of the liquid developing agent described above.

The pigment used for each of the liquid developing agent, e.g., cyan toner was CYANINE BLUE KRO (commercial name: manufactured by SANYO COLOR WORKS, Ltd).

The weight ratio of resin to pigment in each liquid developing agent was set to 4:1. The glass-transition temperature of the toner image is about 45° C. and the surface temperature of the image carrier 1 was a room temperature (20 to 30° C.).

The liquid developing agent or toner image which stuck to the electrostatic latent image on the image carrier 1 by the first developing device 4*a* reaches to the drier 5 before transfer without changes, and is dried there to remove the solvent to some extent. Although it may then be transferred primarily to the intermediate transfer roller 6, it is subjected to second, third, and fourth developments in the present invention.

That is, a second electrostatic latent image is formed on the image carrier 1 by the second charger 2*b* and the second laser exposure system 3*b*. This second electrostatic latent image is developed by the second developing device 4*b* contains a second developing agent of a color different from hat of the liquid developing agent contained in the first developing device 4*d*. Accordingly, toner images in two colors are formed on the image carrier 1 after the second development.

Likewise, third and fourth charging, exposure, and development are carried out so that a full-color toner image is formed on the image carrier 1.

The toner image thus formed is thereafter dried by the drier 5 to some extent and is subsequently transferred to the intermediate transfer roller 6. The intermediate transfer roller 6 has a structure in which silicone rubber, urethane rubber, or the like which is 0.1 to 5 mm thick is applied or coated on the roller surface. The surface hardness thereof is 1 to 70° (JIS-A).

The image carrier 1 should desirably be arranged such that a silicone-based or fluorine-based releasing layer which is 0.1 to 5 mm thick is applied onto the photoconductive layer thereby to adjust the surface energy to 15 to 30 dyne/cm.

The pre-transfer dryer 5 blows air onto the toner image and the image carrier 1, and the toner image is thereby dried to some extent. In this situation, the silicone intermediate transfer roller 6 having a hardness of about 50° is pressed into contact with the surface of the image carrier 1 and is rotated as a slave. Excellent first transfer can thus be performed. The contact pressure between the image carrier 1 and the intermediate transfer roller is preferably about 0.1 to 20 kg/cm, calculated as the line pressure in the lengthwise direction of the image carrier 1.

The toner image transferred to the intermediate transfer roller 6 is secondarily transferred to the surface of an object P to which transfer is achieved, e.g., a paper or the like. The pressure application roller 7 and the intermediate transfer roller 6 are respectively provided with the heaters 8*a* and 8*b*, as described above, and are heated to the glass-transition temperature (45° C. in this case) or higher.

The toner image on the intermediate transfer roller 6 kept heated reaches a secondary transfer region where the paper P as a transfer material is sandwiched between the intermediate transfer roller and a final transfer means, applied with a load 0.2 to 20 kg/cm calculated in the line pressure in the lengthwise direction. The toner image is thereby transferred to the paper. The temperature at the secondary transfer is arranged such that the transfer speed is 200 mm/sec at 100° C. in the experiment, so that an excellent transfer efficiency can be achieved.

Figure 2:
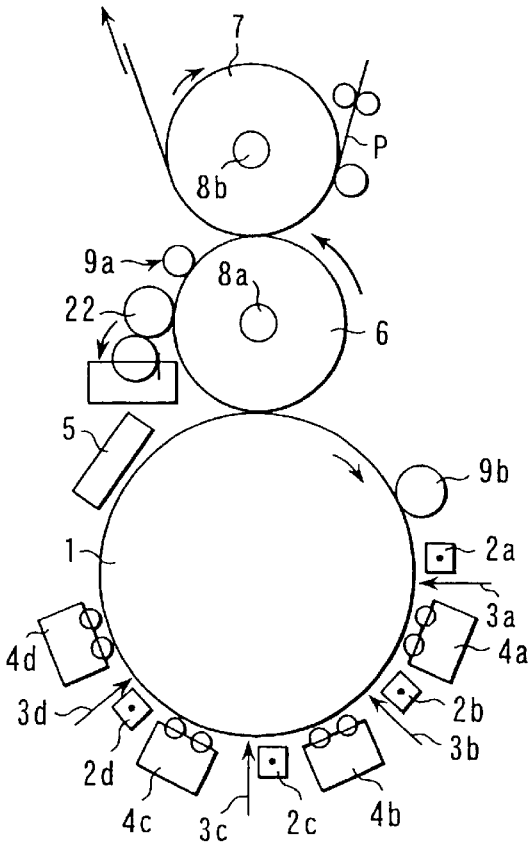
FIG. 2 is a view showing a wet electrophotographic apparatus according to an embodiment of the present invention.

FIG. 2 shows an image forming apparatus according to an embodiment of the present invention. This image forming apparatus comprises a device 22 which applies silicon oil to the intermediate transfer member 6 before primary transfer. The viscosity of the used silicone oil is preferably about 10,000 (cst) or higher. By applying this silicone oil to the intermediate transfer member, primary transfer can be carried out excellently.

Although the application device 22 for silicone oil generally comprises a roller which is pressed into contact with an intermediate transfer roller, it is possible to use a type of device in which plural rollers are interposed so that the application amount is adjusted by a blade or the like. Alternatively, it is possible to use a device which uses a rubber roller impregnated previously with silicone oil or the like to apply silicone oil gradually.

The application amount of silicone oil is effective when it is $1\times10^{-5}$ $\mu$ litters or more per 1 $cm^2$ of the surface of the intermediate transfer roller 6. However, when it exceeds $1\times10^{-1}$ $\mu$ litters, both of the primary transfer and secondary transfer become instable, and besides, the photoconductive member cleaner and the like are burdened much unpreferably.

Figure 3:
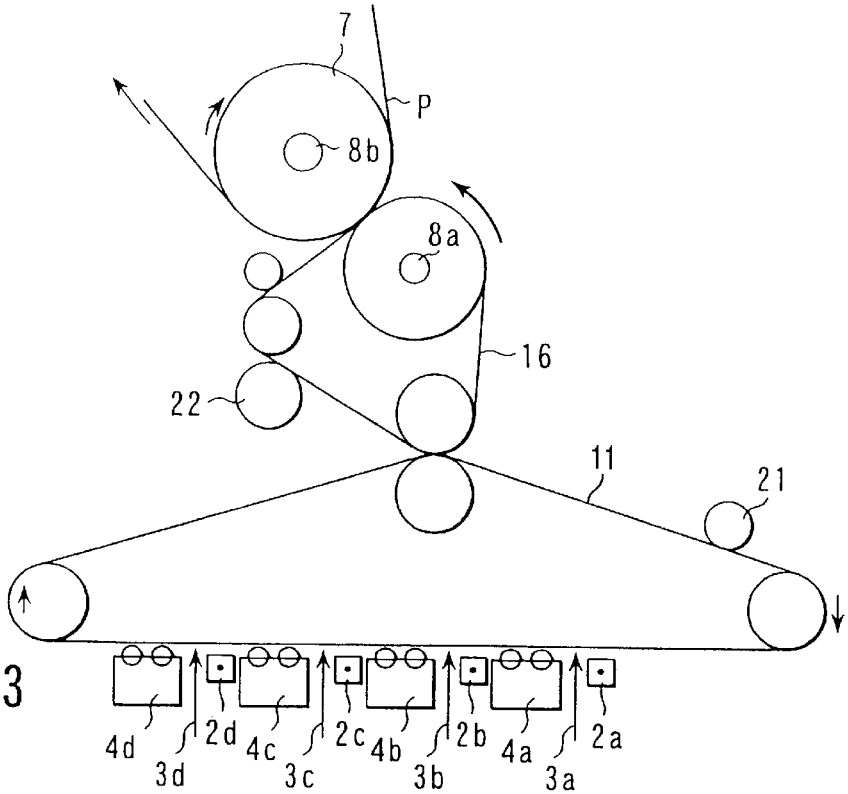
FIG. 3 is a view showing a wet electrophotographic apparatus using a belt-like intermediate transfer member, according to another embodiment of the present invention.

FIG. 3 shows an image forming apparatus which comprises a belt-like photoconductive member 11 and an intermediate transfer member 16 having a belt structure, and a difference is provided in the surface temperatures between the primary transfer and the secondary transfer. In an experiment which was carried out by the present inventors, the temperature of the intermediate transfer belt in the secondary transfer side was set to about 110° C. and the temperature of the intermediate transfer belt in the primary transfer side was set to about 40° C. In this case, plural types of dimethyl silicon oil (TOS-GUARD 451 series: manufactured by TOSHIBA SILICONE KABUSHIKI-KAISHA) were mixed and used. The viscosity of the silicone oil was 15,000 (cst) at the temperature at the time of the primary transfer and was 5,000 (cst) at the temperature at the time of the secondary transfer. Under these conditions, both of the primary transfer and the secondary transfer can be achieved excellently.

Figure 4:
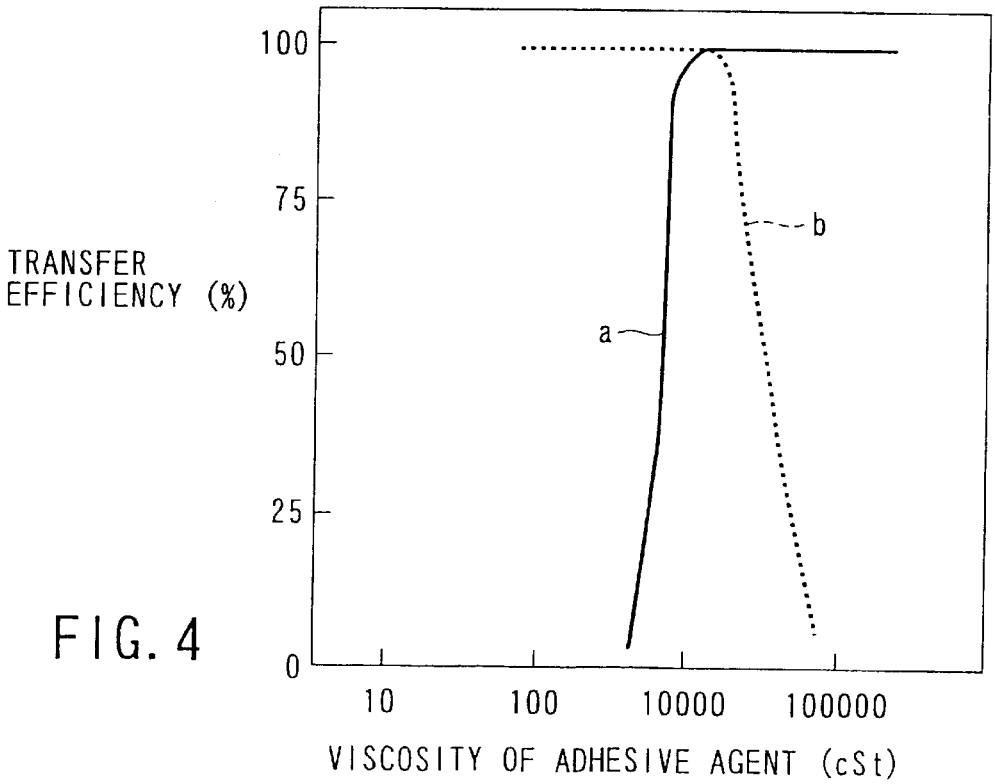
FIG. 4 is a graph showing a relationship between viscosity of an adhesive agent and a transfer efficiency.

FIG. 4 shows the relationship between the primary transfer characteristic and the secondary transfer characteristic and the viscosity of the silicone oil. In FIG. 4, the curve a and the curve b respectively indicate the primary transfer characteristic and the secondary transfer characteristic, respectively. From the curves a and b, it can be understood that primary transfer can be performed excellently when the viscosity of the silicone oil is about 10,000 (cst) or higher and that secondary transfer can also performed excellently when the viscosity of the silicone oil is about 12,000 (cst) or lower.

Thus, the range of the viscosity of silicon oil which can satisfy both of the primary transfer and the secondary transfer is narrow. In addition, in order to perform transfer stably, it is desired that the viscosity at the time of primary transfer is about 15,000 (cst) or higher and that the viscosity at the time of primary transfer is about 10,000 (cst) or lower. Within this viscosity range of silicone oil, both of the primary transfer and the secondary transfer are not performed.

If ester oil or the like is used without using dimethyl silicone oil as an adhesive agent, a viscosity change close to a two-digit number so that it is easy to maintain stability of both of primary transfer and secondary transfer.

In addition, the application device 22 for the adhesive agent need not always be pressed into contact with the intermediate transfer member 16 but may be moved apart from the intermediate transfer member 16 simultaneously by separating operation from the belt-like photoconductive member 11 of the primary transfer station. Further, application of the adhesive agent need not always be performed constantly but the performance of the intermediate transfer member can be maintained to be high by performed it periodically. Although depending on the amount applied per one application, for example, the lifetime of the intermediate transfer member 16 was extended twice or more by only applying oil to the intermediate transfer member 16 at a rate of one application per 100 paper sheets.

The following Table 1 shows a result of a life test. In the following Table 1, the numeric values described in the column of primary transfer express that the primary transfer could not be carried out sufficiently any more at the number of sheets. The numeric values described in the column of secondary transfer express that the secondary transfer could not be carried out sufficiently any more at the number of sheets.

TABLE 1

| | Application amount ($\mu$1/cm$^2$) | Primary transfer | Secondary transfer |
|---|---|---|---|
| The present invention is not applied | | | 8k |
| Silicone oil is applied always | $1 \times 10^{-5}$ | | 15k |
| | $1 \times 10^{-4}$ | | 40k |
| | $1 \times 10^{-3}$ | | 40k |
| | $1 \times 10^{-2}$ | | 55k |
| | $1 \times 10^{-1}$ | 30k | |
| Silicone oil is applied every time 100 sheets are printed | $1 \times 10^{-4}$ | | 20k |
| Silicon oil is applied each before primary transfer and before secondary transfer | $1 \times 10^{-5}$ | | 30k |
| | $1 \times 10^{-4}$ | | 30k |
| | $1 \times 10^{-3}$ | | 40k |
| | $1 \times 10^{-2}$ | | 50k |
| | $1 \times 10^{-1}$ | 30k | |

As is apparent from the above Table 1, if silicone oil is not applied to the transfer member, the intermediate transfer member is deteriorated upon transfer of 8,000 sheets and secondary transfer cannot be carried out any more. In contrast, if silicone oil is applied to the transfer member, the transfer performance can be maintained even upon transfer of about 15,000 to 50,000 sheets.

In the case of the present invention, it has already been described that, if the viscosity of the adhesive agent is low, the adhesive agent serves as a releasing agent thereby involving a situation which is disadvantageous for primary transfer. Even using such an adhesive agent, primary transfer can be achieved and an advantage is obtained in secondary transfer, if the application amount is small. With silicone oil having viscosity of 10,000 (cst) or lower, the maximum application amount which enables primary transfer is substantially determined depending on the viscosity. By applying the oil little by little within a range which does not exceed it, the lifetime of the secondary transfer performance can be extended.

Figure 6:
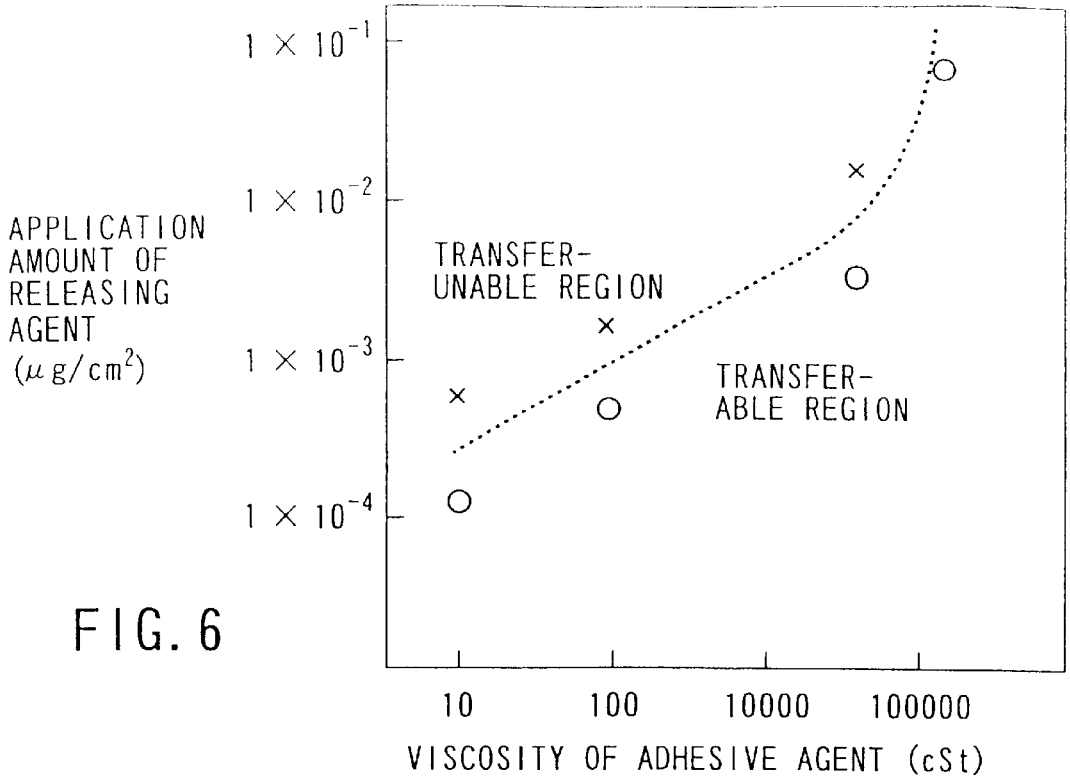
FIG. 6 is a graph showing a relationship between viscosity of silicone oil and a maximum application amount which enables primary transfer.

FIG. 6 shows an experimental result indicating a relationship between the viscosity of silicon oil and the maximum application amount which enables primary transfer. From FIG. 6, for example, it is understood that primary transfer can be achieved if silicone oil having viscosity of 1,000 (cst) at the time of primary transfer is applied by an amount of about $1\times10^{-3}$ $\mu$l/cm$^2$.

Figure 14:
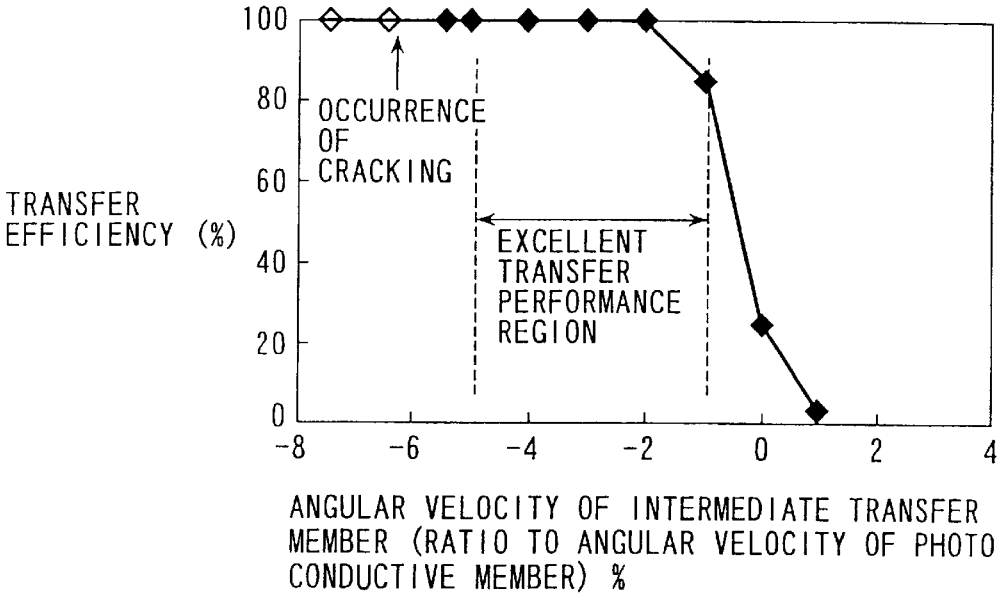
FIG. 14 is a graph showing a relationship between a reduction rate of an angular velocity of an intermediate transfer member to an angular velocity of a photoconductive member and a transfer efficiency.

In this case, in normal primary transfer, the transfer performance tends to be lowered easily, and therefore, the primary transfer is stabilized by increasing the surface speed of the photoconductive member to be higher than the surface speed of the intermediate transfer member. FIG. 14 is a graph showing the change of the transfer efficiency in case where the angular velocity of the intermediate transfer member is changed in relation to the photoconductive member. From FIG. 14, it can be understood that an excellent transfer efficiency of 80% or higher can be obtained by setting the surface speed of the photoconductive member to be higher by 1% than the surface speed of the intermediate transfer member. However, if 6% is exceeded, cracking occurred on the surface of the intermediate transfer member. It is hence understood that an excellent result can be obtained by setting the surface speed of the photoconductive member to be higher by 1 to 5% than the surface speed of the intermediate transfer member.

By thus providing a difference in the speed between the surface of the photoconductive member and the intermediate transfer member, primary transfer is stabled and can be achieved together with the secondary transfer even if a releasing agent is applied to the intermediate transfer medium.

Figure 5A:
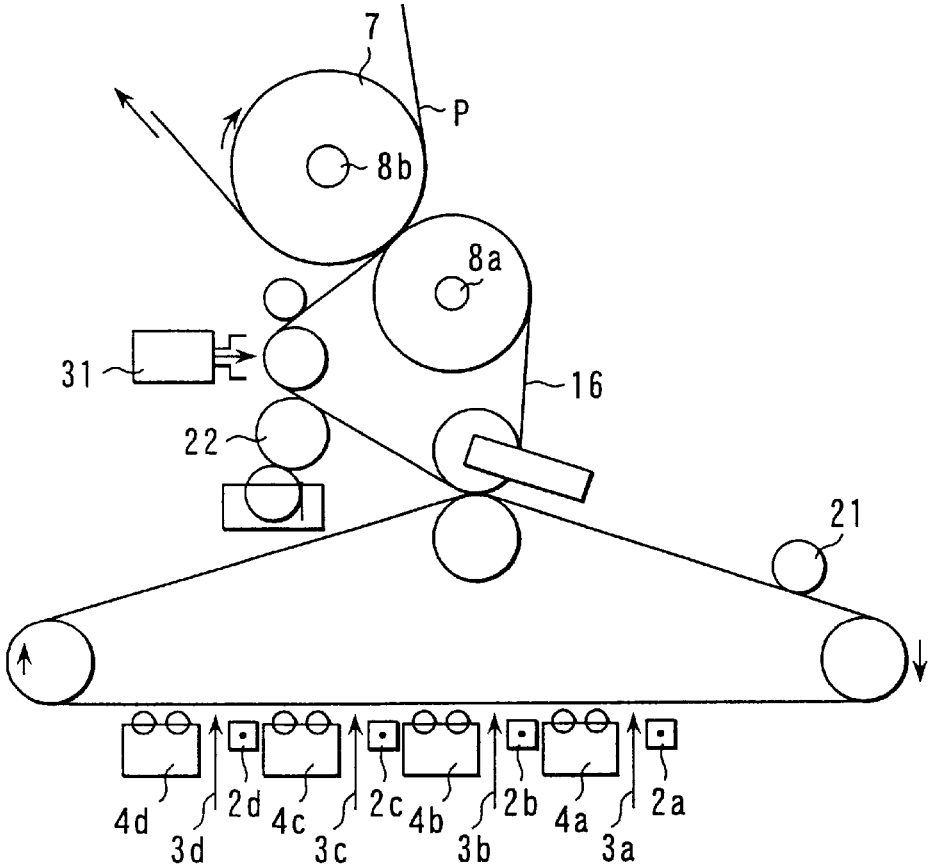
FIG. 5A is a view showing a wet electrophotographic apparatus provided with a device which cools the surface of an intermediate transfer member after secondary transfer, according to another embodiment of the present invention.
Figure 5B:
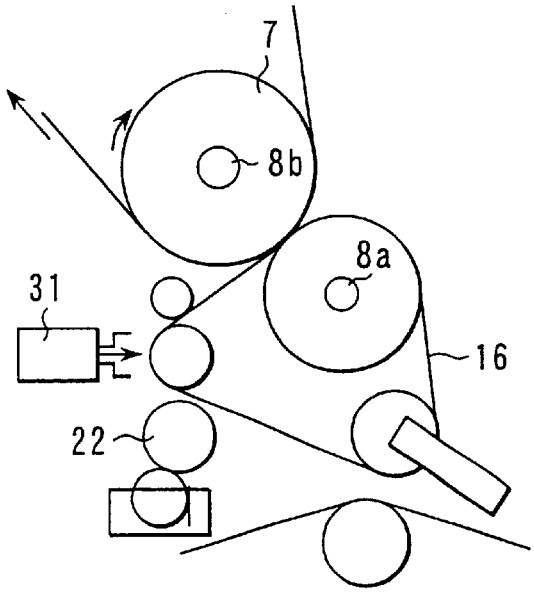
FIG. 5B is a view showing a dry electrophotographic apparatus comprising a mechanism which makes an adhesive agent application device apart, according to another embodiment of the present invention.

Further, in this case, as shown in FIGS. 5A and 5B the advantage can be more improved by setting a belt-like intermediate transfer member and by changing the temperature between the time of primary transfer and the time of secondary transfer. Dimethyl silicone, which has viscosity of 1,000 (cst) when the temperature of the belt transfer member at the time of primary transfer is about 40° C., has viscosity of 500 (cst) or less when the temperature is 100° C. In this case, even when the application amount is set to about $1\times10^{-4}$ $\mu$l/cm$^2$ in order to more stabilize primary transfer, the secondary transfer characteristic becomes more advantageous in correspondence with the decrease of the viscosity and the performance is not lowered greatly. By thus lowering the temperature at the time of primary transfer and by increasing the temperature at the time of secondary transfer, both of the primary transfer and the secondary transfer can be achieved more stably.

The following Table 2 shows a result of carrying out an endurance test of a transfer member with use of an image forming apparatus according to the present invention.

TABLE 2

| | Application amount ($\mu$1/cm$^2$) | Primary transfer | Secondary transfer |
|---|---|---|---|
| The present invention is not applied | | | 8k |
| Silicone oil is applied always | $1 \times 10^{-5}$ | | 15k |
| | $1 \times 10^{-4}$ | | 40k |
| | $1 \times 10^{-3}$ | | 40k |
| | $1 \times 10^{-2}$ | | 55k |
| | $1 \times 10^{-1}$ | 30k | |
| Silicone oil is applied every time 100 sheets are printed | $1 \times 10^{-4}$ | | 20k |
| Silicon oil is applied each before primary transfer and before secondary transfer | $1 \times 10^{-5}$ | | 30k |
| | $1 \times 10^{-4}$ | | 30k |
| | $1 \times 10^{-3}$ | | 40k |
| | $1 \times 10^{-2}$ | | 50k |
| | $1 \times 10^{-1}$ | 30k | |

From the above Table 2, it is understood that, although the endurance of the secondary transfer is improved even when the releasing agents in the primary transfer and the secondary transfer have equal viscosity, the endurance of the secondary transfer is more improved when the temperature is raised and the viscosity of the releasing agent is lowered in the side of the secondary transfer.

By thus applying a small amount of releasing agent having low viscosity, the endurance of the secondary transfer can be improved without making harmful influences on the primary transfer.

Figure 7:
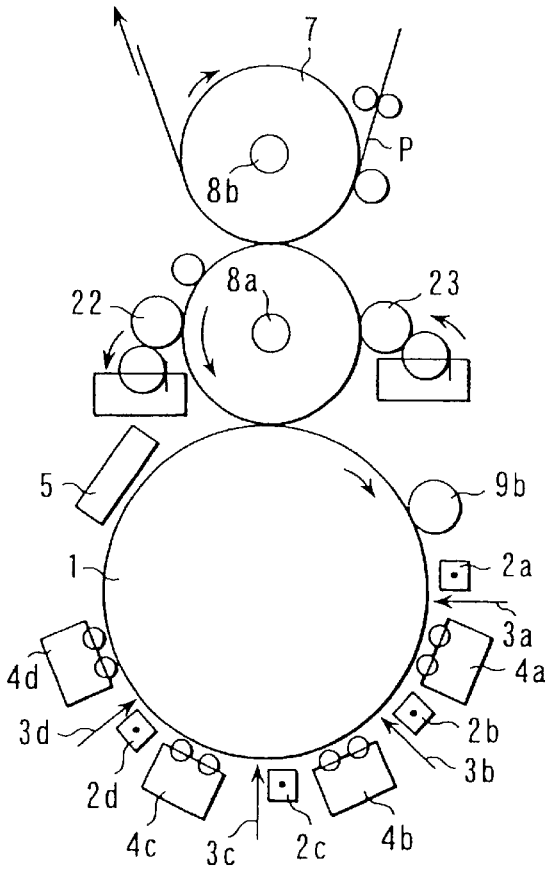
FIG. 7 is a view showing a wet electrophotographic apparatus further provided with an application device for an adhesive agent before secondary transfer, according to another embodiment of the present invention.

FIG. 7 shows an image forming apparatus in which an application device 23 for an adhesive agent is further provided before the secondary transfer.

Used as the adhesive agent to be applied before primary transfer was oil which is mixed with dimethyl silicone oil (based on TOS-GUARD 451: manufactured by TOSHIBA SILICONE KABUSHIKI-KAISHA) and has viscosity of about 10,000 (cst) at 80° C. Used as the adhesive agent to be applied before secondary transfer was also oil which is mixed with one based on TOS-GUARD 451 and has viscosity of about 50,000 (cst) at 80° C., likewise. As a result of this, excellent primary transfer and secondary transfer can both be achieved, as shown in the above Table 1.

Figure 8:
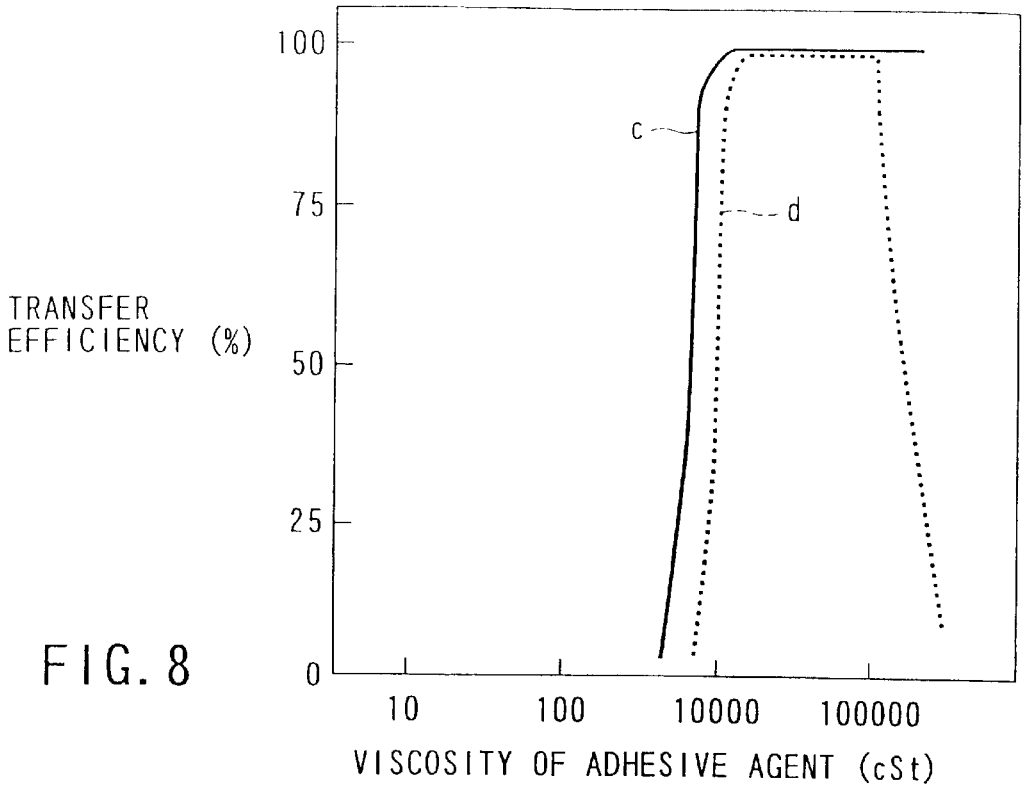
FIG. 8 is a graph showing a relationship between viscosity of silicone oil applied before primary transfer and viscosity of silicone oil applied after secondary transfer and a transfer efficiency.

FIG. 8 shows the relationship between the viscosity of silicone oil applied before primary transfer and the viscosity of silicone oil applied before secondary transfer and the transfer efficiency. In FIG. 8, the curve c indicates the relationship between the viscosity and the transfer efficiency of the silicone oil applied before the primary transfer. The curve d indicates the relationship between the viscosity and the transfer efficiency of the silicone oil applied before the secondary transfer.

As shown in FIG. 8, an adhesive agent of 10,000 (cst) or lower is suitable before the primary transfer, like in the structure explained previously. An adhesive agent applied before the secondary transfer is the agent when the viscosity of the adhesive agent applied before the primary transfer is set to about 10,000 (cst). Hence, it is found that an advantage can be attained if an agent having viscosity higher than it is used.

Next, explanation will be specifically made of a counter measure against sticking of a paper to the intermediate transfer member at the time of secondary transfer which causes a problem particularly when silicone rubber or the like is used for the intermediate transfer medium.

In case where a paper or the like sticks to a transmission member or the like, a method in which the transfer member is constructed into a belt structure and is subjected to curvature separation is known in many cases. Therefore, like this case, it is possible to consider a method in which the roller used for the belt-like transfer member is constructed to have a small diameter and is separated by taking advantage of its curvature. However, in case where the roller itself has a small diameter, the transfer nip cannot be much wide, and the distance by which the belt-like transfer member is wound about the roller before secondary transfer is short. Therefore, even if the roller is heated, the belt-like transfer member cannot be heated sufficiently, so that the toner image on the belt-like transfer member cannot be heated sufficiently, thereby lowering the transfer efficiency unstably.

In particular, this tendency is conspicuous when the process speed is high. When a transfer experiment was carried out using a roller of Φ30 at a speed of 200 mm/s or higher, the secondary transfer performance is lowered extremely. At this time, the distance by which the belt was wound about the roller was about 35 mm and it takes 0.2 seconds or less calculated in a pre-heating time.

Meanwhile, when a roller having a diameter of about 50 mm was used to enlarge the roller of the belt-like transfer member, secondary transfer could be carried out stably. Further, the wounding distance at this time was about 60 mm, and the pre-heating time was about 0.3 seconds. However, with a roller having a diameter of 50 mm, the paper sticks to the transfer member, so that the paper cannot pass through excellently.

Figure 9:
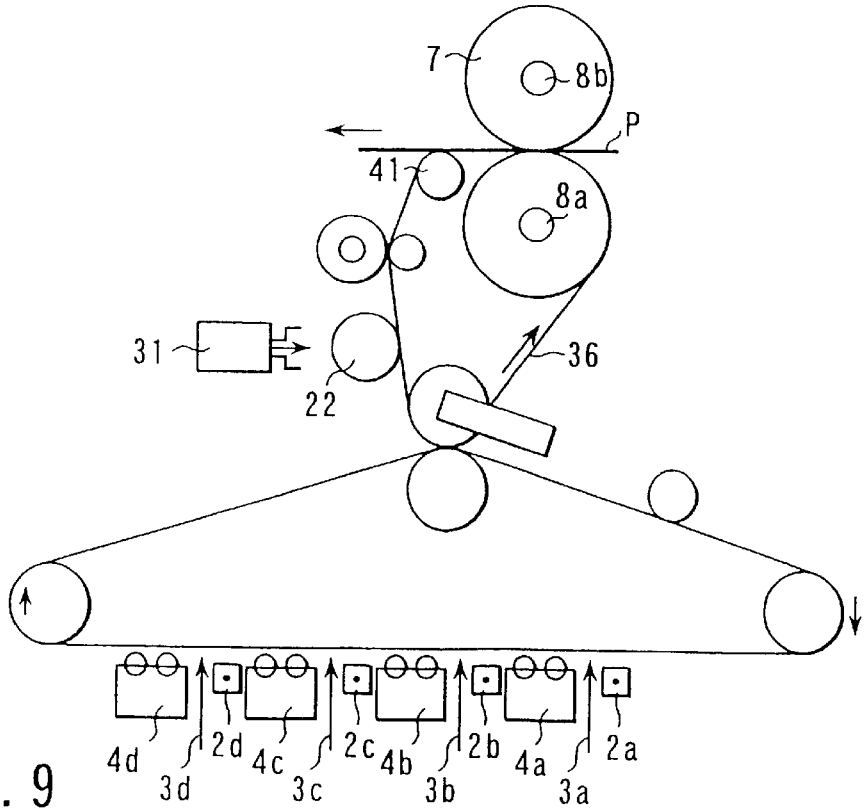
FIG. 9 is a view showing a wet electrophotographic apparatus provided with a separation roller having a large curvature after secondary transfer, according to another embodiment of the present invention.

FIG. 9 shows an image forming apparatus according to another embodiment of the present invention. This image forming apparatus comprises a belt intermediate transfer member 36 having a structure in which silicone rubber having a thickness of about 0.1 to 5 mm is coated on a seamless belt made of polyimide resin or metal. A toner image on an image carrier is pressed into contact with a belt intermediate member by a primary transfer roller and is transferred onto the intermediate member. Thereafter, it is transferred and fixed simultaneously to a paper by a backup roller (impression cylinder) 7. At this time, the paper sticks to the intermediate member and cannot be separated therefrom. Therefore, a separation roller 41 which has a large curvature is provided in the downstream side of the secondary transfer roller. The smaller the diameter of the separation roller 41, the more possible the curvature separation. However, if the diameter is extremely small, bending and loads to the belt increase involving a problem in endurance. It is hence preferred that the diameter is 16 to 40 mm or is substantially about 30 mm. The intermediate transfer belt 36 is slightly cooled by natural cooling from the secondary transfer nip to the separation roller.

As shown in FIG. 9, in case of using the separation roller 41, an adhesive agent and a releasing agent can be applied to the intermediate transfer member 36. In this case, the temperature of the separation roller 41 should preferably be adjusted so that the viscosity of the adhesive agent on the belt intermediate member might not become too high. This is because excellent separation cannot be achieved if the viscosity of the adhesive agent is too high when peeling a paper P. However, since the separation roller 41 has a small diameter, it is difficult to insert a heater lamp to the inside.

Therefore, print operation is carried out after heat is sufficiently transmitted to the separation roller 41 from the belt intermediate transfer member 36. Alternatively, there is a method in which a heated member such as a roller or the like is pressed into contact with the separation roller 41, to heat the separation roller 41.

Figure 10:
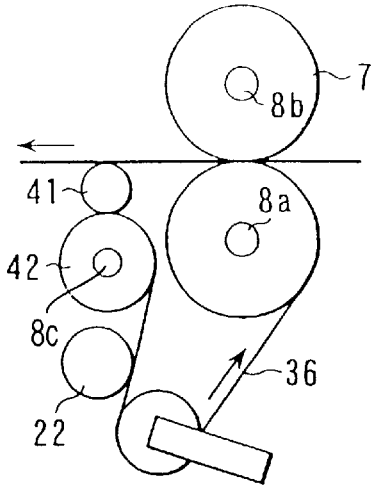
FIG. 10 is a view showing a wet electrophotographic apparatus provided with a cleaning roller pressed into contact with a separation roller immediately after a paper is separated, according to another embodiment of the present invention.

For example, as shown in FIG. 10, the structure may be arranged such that an intermediate cleaning roller 42, having a heater 8*c*, is pressed into contact with the separation roller 41 immediately after separating a paper, with the belt 36 inserted therebetween, and the separation part can also be heated at the same time when it is heated, By adopting this structure, the number of heaters can be reduced.

Figure 11:
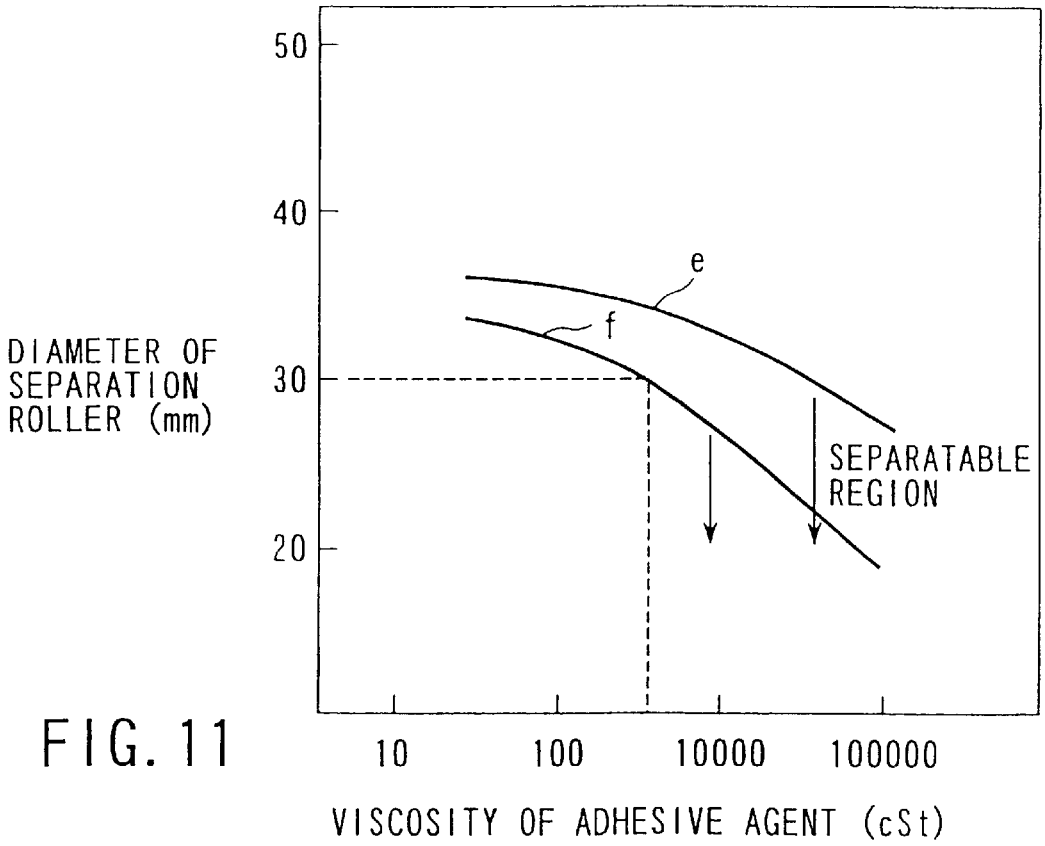
FIG. 11 is a graph showing a relationship between a separation roller diameter and viscosity of an adhesive agent.

FIG. 11 is a graph of investigation as to whether papers can be separated from the intermediate transfer member while changing the adhesive agent and the viscosity of the releasing agent at the separation roller. In FIG. 11, the curve e indicates the case where the application amount is $1\times10^{-2}$ $\mu g/cm^2$, and the curve f indicates the case where the application amount is $1\times10^{-3}$ $\mu g/cm^2$.

Within the experimented range, the separation performance is stabled more as the viscosity of the adhesive agent r the releasing agent is lower, and the separation performance is stabled more as the application amount is larger. In case of using a separation roller of Φ30, the separation performance is stabled when the viscosity is substantially 4000 (cst) or lower. For example, at this time, the viscosity is preferably 10,000 or lower at the time of secondary transfer, and further, the viscosity preferable for primary transfer is 15,000 (cst) or higher. That is, there exists a relationship of viscosity at the time of primary transfer>viscosity at the time of secondary transfer>viscosity at the time of paper separation.

Figure 12:
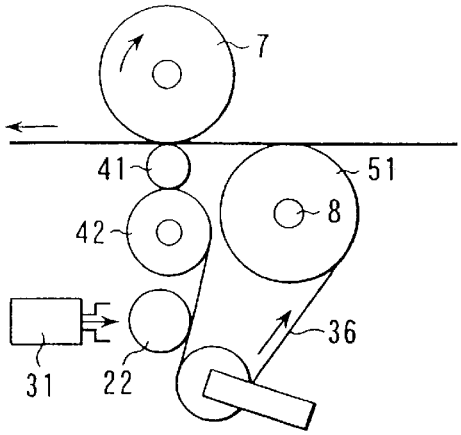
FIG. 12 is a view showing a wet electrophotographic apparatus provided with a pre-heat roller in an upstream side of a secondary transfer station, according to another embodiment of the present invention.

In addition, as shown in FIG. 12, the transfer roller 12 itself is configured to have a small diameter so that the paper can be separated at the same time when the transfer is performed. In this case, since the transfer/separation roller 41 has a small diameter, it is difficult to heat sufficiently the toner image on the belt transfer member before transfer, as has been described previously. Hence, as shown in FIG. 12, in the upstream side of the secondary transfer station constructed by the transfer roller having a small diameter and an impression cylinder, a pre-heat roller 51 including a heat means 8 may be provided on the back surface of the belt. By enlarging the diameter of the pre-heat roller to be relatively large, the pre-heat time can be gained. In the downstream side thereof, a pressure of 0.2 to 20 kg/cm is applied by the transfer roller 41 having a small diameter, so that excellent transfer is enabled and curvature separation can be immediately achieved.

Figure 13:
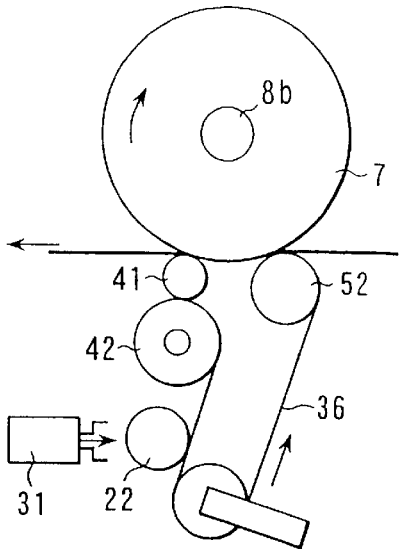
FIG. 13 is a view showing a wet electrophotographic apparatus provided with a pressure roller opposed to a pre-heat roller, which lets a transfer belt and a paper tightly contact each other.

Also, as shown in FIG. 13, by further providing a press contact means for making the belt transfer member and a paper into tight contact with each other, the paper can also be pre-heated before transfer. That is, in FIG. 13, the impression cylinder 7 is arranged to have a large diameter, and the paper is pressed into tight contact with the intermediate transfer belt by a tight contact roller 52, so that the paper and the toner image on the intermediate transfer member 36 are heated sufficiently.

The pressure of the tight contact roller 52 need only be 0.02 kg/cm or more. Thereafter, a pressure of 0.2 to 20 kg/cm is applied by the transfer/separation roller 41 having a small diameter, so that transfer is carried out and the paper is separated due to the curvature of the transfer/separation roller 41. This case cites an example in which one impression cylinder is provided, impression cylinders may be separately provided for the time of tight contact and for the time of transfer. In this case, an advantage can be attained if an adhesive agent is applied to the belt transfer member 36. If the viscosity at the time of primary transfer is set to be high and the viscosity at the time of secondary transfer is set to be low, a preferable result can be obtained, needless to say.

In the above, explanation has been made of examples in which the viscosity or the releasing characteristic of the intermediate transfer member is controlled or a separation roller is used. However, in the present invention, the transfer efficiency of the primary transfer can be increased by providing a difference between the surface speeds of the photoconductive member and the intermediate transfer member, as described previously. If it is combined with a structure in which the above-described adhesive agent or releasing agent is applied or a separation roller is used, a greater advantage can be attained.

As has been explained above, according to the present invention, it is possible to stabilize the viscosity of the adhesive agent at the time of primary transfer from a photoconductive member to an intermediate transfer member and the viscosity at the time of secondary transfer from the intermediate transfer member to a member to which transfer is to be performed, throughout both of the primary transfer and the secondary transfer, by applying an adhesive agent such as silicone oil or the like to an intermediate transfer member and by changing the temperature of the intermediate transfer member or by applying adhesive agents having different viscosities. In addition, papers can be peeled by taking advantage of curvature to pass through, by using a belt-like intermediate transfer member and by using a separation roller or a transfer roller which has a large curvature.

Further, by increasing the surface speed of the photoconductive member to be higher than the surface speed of the intermediate transfer member, the developer image on the surface of the photoconductive member can be transferred efficiently to the intermediate transfer member.

What is claimed is:

1. An image forming apparatus comprising:

an image carrier;

an electrostatic latent image forming mechanism which forms an electrostatic latent image on the image carrier;

a developing mechanism which develops the electrostatic latent image on the image carrier to attain a visible image;

a first transfer mechanism which presses an intermediate transfer member into contact with the image carrier, to transfer the visible image on the image carrier to the intermediate transfer member;

an application mechanism which applies a viscous material onto the intermediate transfer member; and a second transfer mechanism which transfers a transferred image transferred to the intermediate transfer member to a transfer member to which transfer is to be done, wherein a surface speed of the image carrier is different from a surface speed of the intermediate transfer member.

2. The apparatus according to claim 1, further comprising a mechanism which performs control such that a viscosity of the viscous material applied to the intermediate transfer member at the second transfer mechanism is lower than a viscosity thereof at the first transfer mechanism.

3. The apparatus according to claim 2, wherein the viscous material is silicone oil, and the mechanism which controls the viscosity of the viscous material raises a surface temperature of the intermediate transfer member at the second transfer mechanism to be higher than that of the intermediate transfer member at the first transfer mechanism.

4. The apparatus according to claim 2, wherein the viscosity of the viscous material at the first transfer mechanism is 10,000 to 100,000 cst, and the viscosity of the viscous material at the second transfer mechanism is 50 to 10,000 cst.

5. An image forming apparatus comprising:

an image carrier;

an electrostatic latent image forming mechanism which forms an electrostatic latent image on the image carrier;

a developing mechanism which develops the electrostatic latent image on the image carrier to attain a visible image;

a first transfer mechanism which presses an intermediate transfer member into contact with the image carrier, to transfer the visible image on the image carrier to the intermediate transfer member;

an application mechanism which applies a releasing agent onto the intermediate transfer member, in an upstream side of the first transfer mechanism; and a second transfer mechanism which transfers a transferred image transferred to the intermediate transfer member to a transfer member to which transfer is to be done, by applying pressure and heat thereto, wherein a surface speed of the image carrier is different from a surface speed of the intermediate transfer member.

6. The apparatus according to claim 5, wherein a surface speed of the image carrier is lower than a surface speed of the intermediate transfer member, thereby to stabilize primary transfer, and secondary transfer is stabilized by a releasing agent.

7. The apparatus according to claim 5, wherein the surface speed of the image carrier is higher than the surface speed of the intermediate transfer member.

8. The apparatus according to claim 5, wherein the surface speed of the image carrier is higher by 1 to 5% than the surface speed of the intermediate transfer member.

9. The apparatus according to claim 5, wherein the releasing agent at the first transfer mechanism has a viscosity of 10,000 or lower and an application amount of $2\times10^{-3}$ $\mu$-litter/cm$^2$ or less.

10. The apparatus according to claim 9, wherein the surface speed of the image carrier is higher than the surface speed of the intermediate transfer member.

11. The apparatus according to claim 9, wherein the surface speed of the image carrier is higher by 1 to 5% than the surface speed of the intermediate transfer member.

12. An image forming apparatus comprising:

an image carrier;

an electrostatic latent image forming mechanism which forms an electrostatic latent image on the image carrier;

a developing mechanism which develops the electrostatic latent image on the image carrier to attain a visible image;

a first transfer mechanism which presses an intermediate transfer member into contact with the image carrier, to transfer the visible image on the image carrier to the intermediate transfer member;

a second transfer mechanism which transfers a transferred image transferred to the intermediate transfer member to a transfer member to which transfer is to be done;

a first application mechanism which applies a first adhesive agent onto the intermediate transfer member, after the transferred image on the intermediate transfer member is transferred to the transfer member to which transfer is to be done, at the second transfer mechanism, before the visible image on the image carrier is transferred to the intermediate transfer member, at the first transfer mechanism; and a second application mechanism which applies a second adhesive agent onto the intermediate transfer member, after the visible image on the image carrier is transferred to the intermediate transfer member, at the first transfer mechanism, before the transferred image on the intermediate transfer member is transferred to the transfer member to which transfer is to be done, at the first transfer mechanism.

13. The apparatus according to claim 12, wherein a viscosity of the first adhesive agent is lower than a viscosity of the second adhesive agent.

14. The apparatus according to claim 12, wherein the first application mechanism and/or the second application mechanism is provided to be in contact with and apart from the intermediate transfer member and applies the adhesive agent to the intermediate transfer member for every constant period.

15. An image forming apparatus comprising:

an image carrier;

an electrostatic latent image forming mechanism which forms an electrostatic latent image on the image carrier;

a developing mechanism which develops the electrostatic latent image on the image carrier to attain a visible image;

a first transfer mechanism which presses a belt-like intermediate transfer member into contact with the image carrier, to transfer the visible image on the image carrier to the intermediate transfer member;

a second transfer mechanism which presses the belt-like intermediate transfer member into contact with a transfer member to which transfer is to be done, by a transfer roller and a pressure application member opposed thereto, thereby to transfer a transferred image on the belt-like intermediate transfer member to the transfer member to which transfer is to be done; and a separation mechanism which is provided in a downstream side of the second transfer mechanism and has a curvature larger than that of the transfer roller, to separate the transfer member to which transfer is to be done, from the belt-like intermediate transfer member, wherein a surface speed of the image carrier is different from a surface speed of the intermediate transfer member.

16. The apparatus according to claim 15, further comprising:

an application mechanism which applies a viscous material onto the belt-like intermediate transfer member; and a mechanism which performs control such that a viscosity of the viscous material at the first transfer mechanism is higher than viscosities thereof at the second transfer mechanism and the separation mechanism.

17. The apparatus according to claim 16, wherein the mechanism which performs the control of the viscosity performs the control such that the viscosity of the viscous material at the first transfer mechanism is higher than the viscosity thereof at the second transfer mechanism, and the viscosity of the viscous material at the second transfer mechanism is higher than the viscosity of the viscous material at the separation mechanism.

18. The apparatus according to claim 15, wherein the separation mechanism is a separation roller about which the belt-like intermediate transfer member is wound, and further comprises a cleaning mechanism which is pressed into contact with the separation roller with belt-like intermediate transfer member inserted therebetween, after separating the transfer member to which transfer is to be done, from the belt-like intermediate transfer member, and a mechanism which heats the cleaning mechanism and the separation roller.

19. The apparatus according to claim 18, wherein the separation roller has a diameter of 30 mm or less.

20. The apparatus according to claim 15, wherein a surface temperature of the belt-like intermediate transfer member at the separation mechanism is equal to or higher than a surface temperature of the belt-like intermediate transfer member.

21. An image forming apparatus comprising:

an image carrier;

an electrostatic latent image forming mechanism which forms an electrostatic latent image on the image carrier;

a developing mechanism which develops the electrostatic latent image on the image carrier to attain a visible image;

a first transfer mechanism which presses a belt-like intermediate transfer member into contact with the image carrier, to transfer the visible image on the image carrier to the intermediate transfer member;

a pre-heat roller which is provided in a downstream side of the first transfer mechanism and heats the belt-like intermediate transfer member from a back surface of the belt-like intermediate transfer member; and a second transfer mechanism which presses the belt-like intermediate transfer member into contact with a transfer member to which transfer is to be done, by a pressure application member, thereby to transfer a transferred image on the belt-like intermediate transfer member to the transfer member to which transfer is to be done, and has a curvature larger than a diameter of 30 mm, thereby to separate the transfer member to which transfer is to be done, from the belt-like intermediate transfer member, wherein a surface speed of the image carrier is different from a surface speed of the intermediate transfer member.

22. An image forming apparatus comprising:

an image carrier;

an electrostatic latent image forming mechanism which forms an electrostatic latent image on the image carrier;

a developing mechanism which develops the electrostatic latent image on the image carrier to attain a visible image;

a first transfer mechanism which presses a belt-like intermediate transfer member into contact with the image carrier, to transfer the visible image on the image carrier to the intermediate transfer member;

a pre-heat tight contact member which is provided in a downstream side of the first transfer mechanism, heats the belt-like intermediate transfer member from a back surface of the belt-like intermediate transfer member, and lets the belt-like intermediate transfer member be into tight contact with the transfer member to which the belt-like intermediate transfer member, by a pressure application member; and a second transfer mechanism which is provided in a downstream side of the first transfer mechanism, presses the belt-like intermediate transfer member into contact with a transfer member to which transfer is to be done, by a pressure application member, thereby to transfer a transferred image on the belt-like intermediate transfer member to the transfer member to which transfer is to be done, and has a curvature larger than a diameter of 30 mm, thereby to separate the transfer member to which transfer is to be done, from the belt-like intermediate transfer member, wherein a pressure applied to the belt-like intermediate transfer member and the transfer member to which transfer is to be done at the pre-heat tight contact mechanism at the second transfer mechanism is larger than a pressure applied to the belt-like intermediate transfer member and the transfer member to which transfer is to be done at the pre-heat tight contact mechanism.

23. The apparatus according to claim 22, further comprising:

an application mechanism which applies a viscous material onto the belt-like intermediate transfer member; and a mechanism which performs control such that a viscosity of the viscous material at second transfer mechanism is higher than a viscosity of the viscous material at the first transfer mechanism and the separation mechanism.

24. An image forming method comprising:

a step of forming an electrostatic latent image on an image carrier;

a step of developing the electrostatic latent image on the image carrier to attain a visible image;

a first transfer step of pressing an intermediate transfer member into contact with the image carrier, to transfer the visible image on the image carrier to the intermediate transfer member;

a step of applying an adhesive agent or releasing agent onto the intermediate transfer member; and a second transfer step of transferring a transferred image transferred to the intermediate transfer member to a transfer member to which transfer is to be done, wherein a surface speed of the image carrier is different from a surface speed of the intermediate transfer member.

25. The method according to claim 24, wherein control is performed such that a viscosity of the adhesive agent or releasing agent applied to the intermediate transfer member at the second transfer step is lower than a viscosity thereof at the first transfer step.

26. The method according to claim 24, wherein the intermediate transfer member is a drum-like transfer member or a belt-like transfer member.

27. An image forming method comprising:

a step of forming an electrostatic latent image on an image carrier;

a step of developing the electrostatic latent image on the image carrier to attain a visible image;

a first transfer step of pressing an intermediate transfer member into contact with the image carrier, to transfer the visible image on the image carrier to the intermediate transfer member, wherein a surface speed of the image carrier is different from a surface speed of the intermediate transfer member;

a second transfer step of transferring a transferred image transferred to the intermediate transfer member to a transfer member to which transfer is to be done;

a first application step of applying a first adhesive agent onto the intermediate transfer member, after the transferred image on the intermediate transfer member is transferred to the transfer member to which transfer is to be done, at the second transfer step, before the visible image on the image carrier is transferred to the intermediate transfer member, at the first transfer mechanism; and a second application step of applying a second adhesive agent to the intermediate transfer member, after the visible image on the image carrier is transferred to the intermediate transfer member, at the first transfer step, before the transferred image on the intermediate transfer member is transferred to the transfer member to which transfer is to be done, at the second transfer step.

28. An image forming method comprising:

a step of forming an electrostatic latent image on an image carrier;

a step of developing the electrostatic latent image on the image carrier to attain a visible image;

a first transfer step of pressing a belt-like intermediate transfer member into contact with the image carrier, to transfer the visible image on the image carrier to the intermediate transfer member;

a second transfer step of pressing the belt-like intermediate transfer member into contact with a transfer member to which transfer is to be done, by a transfer roller and a pressure application member opposed thereto, thereby to transfer a transferred image on the belt-like intermediate transfer member to the transfer member to which transfer is to be done; and a step of separating the transfer member to which transfer is to be done, from the belt-like intermediate transfer member, by a separation roller which is provided in a downstream side of the second transfer mechanism and has a curvature larger than that of the transfer roller.

29. The method according to claim 28, further comprising a step of applying a releasing agent onto the intermediate transfer member, after the transferred image on the intermediate transfer member is transferred to the transfer member to which transfer is to be done, at the second transfer step, before the visible image on the image carrier is transferred to the intermediate transfer member, at the first transfer mechanism.

* * * * *